United States Patent [19]

Allan

[11] 4,137,888

[45] Feb. 6, 1979

[54] SOUND ABATEMENT DEVICE FOR INTERNAL COMBUSTION ENGINE

[75] Inventor: Kenneth N. Allan, Menomonee Falls, Wis.

[73] Assignee: Allis-Chalmers Corporation, Milwaukee, Wis.

[21] Appl. No.: 744,887

[22] Filed: Nov. 24, 1976

[51] Int. Cl.[2] ..... F02B 77/00

[52] U.S. Cl. ..... 123/198 E; 181/204

[58] Field of Search ..... 123/198 E, 195 C, 195 S; 181/204

[56] References Cited

U.S. PATENT DOCUMENTS

| | | | |
|---|---|---|---|
| 2,123,358 | 7/1938 | Gutzner | 123/198 E |
| 3,412,724 | 11/1968 | Scheiterlein et al. | 123/198 E X |
| 3,464,398 | 9/1969 | Scheiterlein et al. | 123/198 E X |
| 3,521,726 | 7/1970 | Freyn | 123/198 E X |
| 3,534,828 | 10/1970 | LePageIver et al. | 123/198 E X |
| 3,949,727 | 4/1976 | Thien et al. | 123/198 E |
| 3,951,114 | 4/1976 | Fachbach et al. | 123/198 E X |
| 3,964,462 | 6/1976 | Thien et al. | 123/198 E |

*Primary Examiner*—Ira S. Lazarus

*Attorney, Agent, or Firm*—Arthur L. Nelson

[57] ABSTRACT

A sound abatement device for an internal combustion engine including a contoured shell resiliently mounted to reduce sound transmission through the shell mounting. The shell is formed of plastic filled with powdered metal to reduce transmission of air transmitted sound from the engine through the shell.

14 Claims, 10 Drawing Figures

SOUND ABATEMENT DEVICE FOR INTERNAL COMBUSTION ENGINE

This invention relates to an internal combustion engine, and more particularly to a sound abatement device including a contoured shell resiliently mounted relative to the engine to reduce sound transmission through the mounting, the shell of powdered metal suspended in a plastic to reduce sound transmission from the engine through the air and the shell to generally provide sound abatement for the engine.

Emission requirements are becoming more restrictive for exhaust as well as sound on engines. It is not feasibly possible to completely encapsulate an engine to reduce sound emission. The engine must operate in a normal manner and maintenance of the engine is imperative. Any enclosure around an engine will tend to reduce the cooling of the engine which is particularly objectionable where the ambient temperatures are high. Accordingly, this invention provides for a sound abatement device which includes a plastic filled with powdered metal to provide some thermoconductivity and high density to reduce the sound emissions. The sound emitted from the engine and transmitted through the air and shell is minimized due to the construction of the shell. The shell is contoured with a small clearance between the shell and engine to minimize the effects of acoustic resonance, to minimize the volume increase of the unit, and the installation constraints. Selected low noise and high maintenance components are mounted on the engine but extend through the shell to facilitate maintenance of these accessories on the engine. By mounting the low noise components on the engine which extend through the shell, the shell can be constructed in sections which can be more easily mounted on the engine or removed from the engine if desired. The actual increase in size of the unit which consists of the engine and the shell is minimized because of the small clearance between the shell and the engine external surface. The shell is resiliently mounted relative to the engine and can also be resiliently mounted relative to the mounting structure for carrying the engine. This reduces transmission of sound through the supporting structure for the shell and the engine and the construction of the shell reduces the sound emission from the shell to thereby provide sound abatement without sacrificing convenience, space or cost.

It is an object of this invention to provide a sound abatement shell of plastic loaded with powdered metal.

It is another object of this invention to provide a sound abatement shell resiliently mounted on engine supporting structure.

It is a further object of this invention to provide a sound abatement device including a shell contoured to the external contour of the engine.

It is a further object of this invention to provide a sound abatement device contoured to the engine and having low emission accessories and high maintenance components extending through the shell for convenience in maintenance.

It is a further object of this invention to provide a sound abatement shell with segmental construction and sealing means between the segments. The shell is contoured to the external surface of the engine to reduce sound emissions and minimize thermal insulation problems by keeping the shell as closely to the size and shape of the engine shape.

The objects of this invention are accomplished by providing a sectionally constructed shell with the shell contoured with the external surface of the internal combustion engine. Low noise emission accessories and high maintenance components are mounted on the engine and extend through the shell. The shell is resiliently mounted relative to the engine and is constructed of a nonmetallic material carrying a powdered metal to deaden the sound emissions from the engine. The unit requires little additional space than a conventional engine without the shell and does not present any unusual requirements for installation in conventional engine installations.

Referring to the drawings, the preferred embodiments of this invention.

Figure 1:
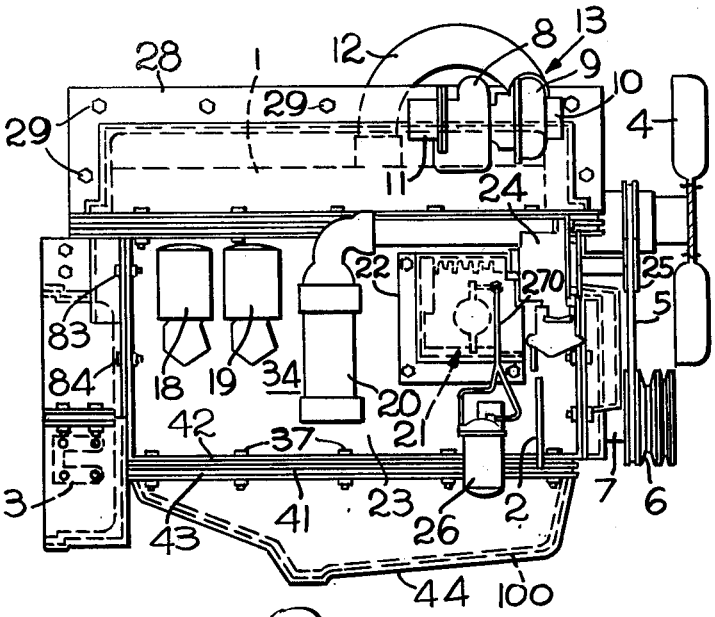
FIG. 1 illustrates a side elevation view of an internal combustion engine carrying a sound abatement shell.
Figure 2:
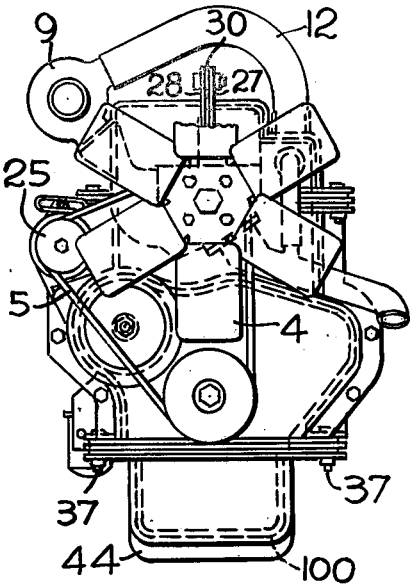
FIG. 2 illustrates an end view of the internal combustion engine carrying the sound abatement shell, as shown in FIG. 1.
Figure 3:
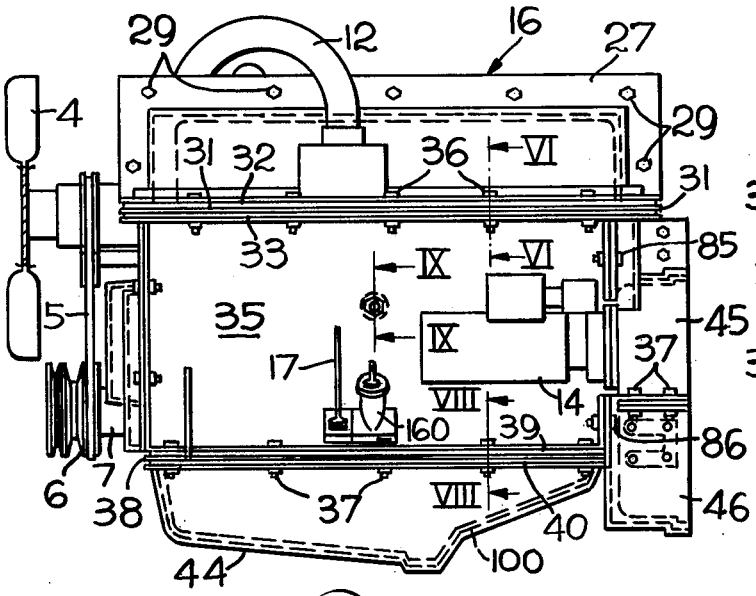
FIG. 3 illustrates a side elevation view taken from the opposite side of the engine from that shown in FIG. 1.
Figure 4:
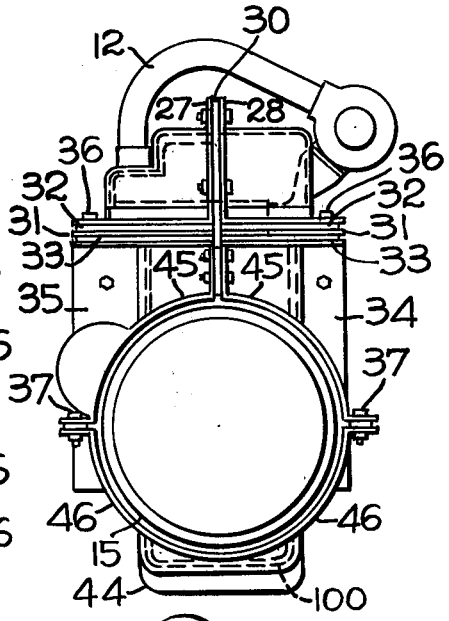
FIG. 4 illustrates an end view of the internal combustion engine shown in FIG. 2 but taken from the opposite end of the engine.

Referring to the drawings, FIGS. 1, 2, 3 and 4 illustrate a sound abatement shell on an internal combustion engine. The engine 1 is adapted for mounting on suitable engine mounts on the mounting flange 2 and the mounting base 3. The fan 4 is driven by the belt 5 from the drive pulley 6 on the drive shaft 7. The compressor 8 is driven by the turbine 9. The turbine 9 exhausts through the exhaust pipe 10. The compressor 8 receives intake air through the intake pipe 11 which is connected to a suitable air cleaner (not shown). A conduit 12 is connected to the exhaust manifold which supplies exhaust gas to the turbine 9 of the turbocharger 13.

A starter 14 is mounted on the engine and drives the flywheel within the flywheel housing 15 for starting the engine. The oil filler passage 160 extends through the shell 16 and is provided with a seal around its periphery. The ullage rod 17 also extends through the shell into the oil pan for checking the oil level of the engine.

The oil filters 18 and 19 are mounted on the engine and connected to the oil passages in the engine. The oil filters 18, 19, however, extend through the shell 16 to the outside of the shell for easy maintenance of the filters. The oil cooler 20 is also connected to internal oil passages in the engine and extends through to the external side of the shell.

The fuel injection pump 21 is mounted on the engine. The section 22 is connected to the section 23 of the shell 16 and encloses the fuel injection pump 21. The alternator 24 is mounted on the internal combustion engine and extends through the shell 16. The alternator 24 is driven by the belt 5 through pulley 25.

The fuel filter 26 is also mounted on the engine and a bracket supporting the fuel filter 26 extends through the shell. The fuel filter 26 is connected by the conduit 270 to the fuel injection pump 21.

The shell 16 includes the upper left-hand section 27 and the upper right-hand section 28. The sections 27 and 28 are connected by a plurality of bolts 29 which extend through front, rear and upper flanges of these sections. A gasket 30 is positioned between these shells 27 and 28 to seal the shells as assembled.

The bracket 31 is mounted on the engine block which supports the right and left-hand sections. The gaskets 32 and 33 are positioned above and below the bracket 31 to seal sections 27 and 28 with the bracket 31 as well as the sections 34 and 35 with the bracket 31.

The plurality of bolts 36 fasten the section 27 and 28 and 35 and 34 on the bracket 31.

The pan section 44 is fastened by a plurality of bolts 37. A bracket 38 supports the lower portion of the sections 34 and 35 and the pan section 44. The gaskets 39 and 40 are positioned intermediate the section 35 and the bracket 38 as well as the pan section 44 and the bracket 38. Similarly, the bracket 41 is positioned intermediate the gaskets 42 and 43 to support the sections 34 and the oil pan section 44 and which are fastened by means of the plurality of bolts 37.

The upper flywheel housing sections 45 and the lower flywheel section 46 are also connected to the sections 34 and 35 by means of the bolts 83 and 84 and 85 and 86.

Figure 5:
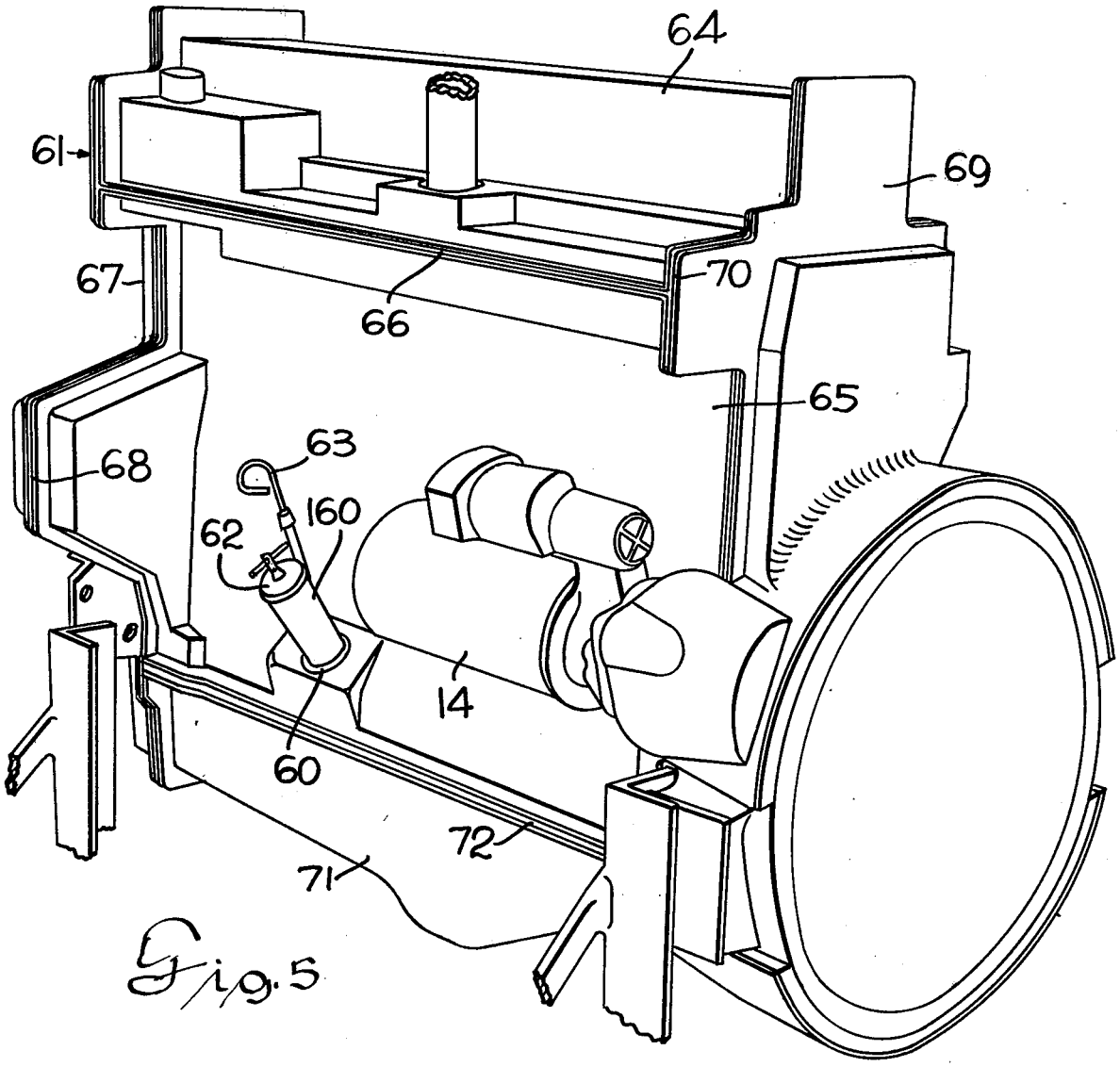
FIG. 5 illustrates a three-dimensional view of a modification of an internal combustion engine carrying a sound abatement shell.
Figure 6:
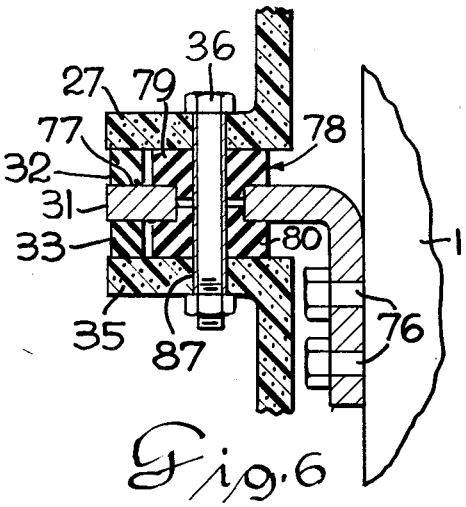
FIG. 6 is a cross section view taken on line VI—VI of FIG. 3 showing a means of mounting a sound abatement shell on the internal combustion engine.

Referring to FIG. 5, a modification of the sound abatement shell is shown. The starter 14 is mounted on the engine and the mount extends through the shell to support the starter 14 externally of the shell. The conduits 160 for adding oil to the crankcase also extends externally of the shell and the seal 60 is provided around the periphery of the tube for sealing the shell 61. The cap 62 is easily removable to add oil to the lubrication system. Also the ullage rod 63 and the sleeve receiving ullage rod are sealed with the shell so that the rod extends externally of the shell for measuring the oil level.

The shell 61 includes the upper segment 64 which is sealed with the lower left-hand segment 65 at the seam 66. The right-hand lower segment (not shown) is also sealed by a similar seam on the opposite side of the engine. The front end plate 67 is sealed by the seam 68 which extends around the engine on both sides to form an air-tight assembly. Similarly, the rear segment 69 is sealed by a seam 70 which extends around the engine on both sides to seal the rear segment 69 with the two side segments of the engine. The oil pan segment 71 is sealed with the lower right-hand and left-hand sections as well as the two end plates to form a sealed enclosure for the engine. The seam 72 also provides a support for the shell in which a gasket and a bracket are sealed together to support the shell in spaced relation to the engine. The sections of the shell are contoured to fit the engine so that the overall sides of the shell are slightly larger than the engine itself and, accordingly, presents little thermal insulation problem due to the bulkiness of the shells of conventional engines.

FIGS. 6, 7, 8, 9 and 10 show structure for supporting the shell on the engine. The bracket 31 is mounted on the engine 1 by the bolts 76. The bracket is formed with a horizontal flange 77 which carries the rubber isolator 78 which is formed by the upper bushing 79 and lower bushing 80. A bolt 36 extends through the upper section 27 and the lower section 35 of the shell. The gaskets 32 and 33 seal the shell with the bracket 31. The bolt 36 is received in the sleeve 87.

Figure 7:
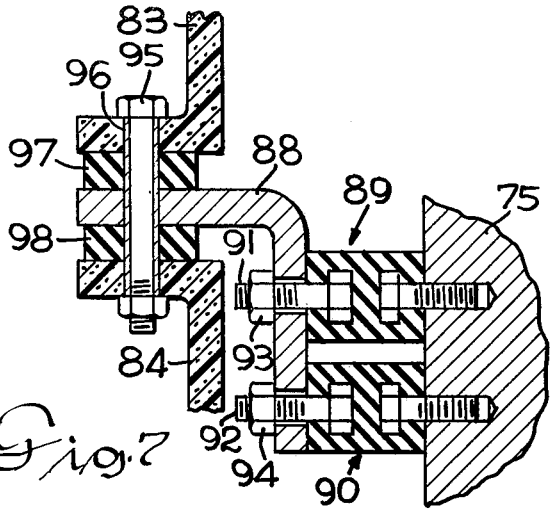
FIG. 7 is a modification of a mounting for the shell on an internal combustion engine.

FIG. 7 shows a bracket 88 mounted by the isolators 89 and 90 on the engine 75. The braket 88 is fastened by the bolts 91 and 92 and nuts 93 and 94. The upper section 83 of the shell and the lower section 84 of the shell are fastened together by the bolt 95 received in the sleeve 96 while the gaskets 97 and 98 seal the sections of a shell with the bracket 88.

Figure 8:
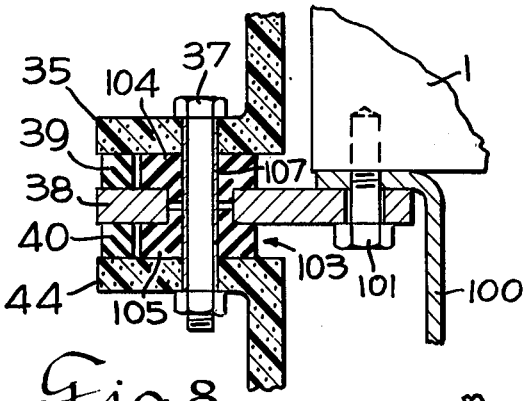
FIG. 8 is a cross section taken on line VIII—VIII of FIG. 3 illustrating a sound abatement shell mounted on an internal combustion engine.

FIG. 8 shows the engine block 1 connected to the oil pan 100 by the bolt 101. The bracket 38 extends transversely of the engine and carries the rubber isolator 103 which includes the upper bushing 104 and lower bushing 105. The bolt 37 and sleeve 107 fasten the sections of the shell on the bracket 38 while the gaskets 39 and 40 seal the upper and lower shell sections with the bracket 38.

Figure 9:
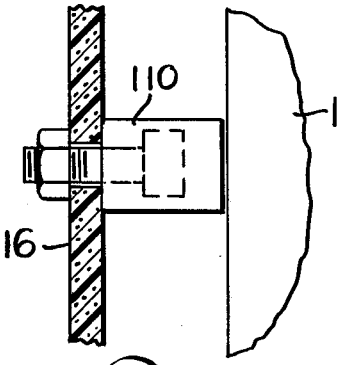
FIG. 9 is a cross section taken on line IX—IX of FIG. 3 illustrating an isolator carried on the shell for reducing vibration and relative movement between the shell and the internal combustion engine.

FIG. 9 illustrates a rubber isolator 110 which engages the side of the engine 1. The shell 16 carries the isolator 110 which bears against the side of the engine to reduce vibration and can be inserted at any point on the engine to reduce vibration and resonance, although the shell, per se, is carried on the brackets as previously described.

Figure 10:
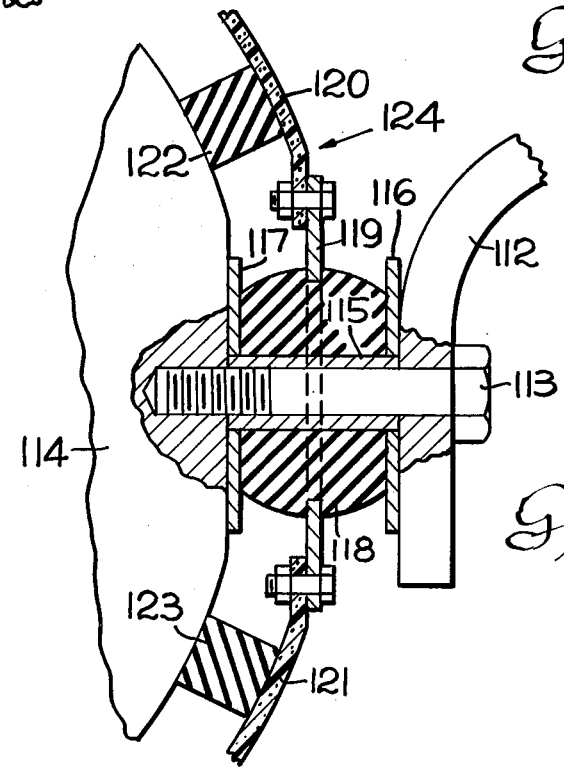
FIG. 10 is a modification of the mounting for the sound abatement shell which is mounted on an isolator carried between the engine mounting and the engine to isolate the shell from the engine mounting as well as the internal combustion engine.

Referring to FIG. 10, a vehicle 112 carries an engine support including a bolt 113 which fastens into the engine 114. A sleeve 115 extending through the spacers 116 and 117 support the rubber isolator 118. The rubber isolator 118 is formed with an annular recess to receive the plate 119 which is fastened to the upper section 120 and the lower section 121 of the shell. The gaskets 122 and 123 are spaced between the upper and lower sections of the shell and the engine 114. Accordingly, the shell 124 is resiliently mounted relative to the chassis of the vehicle 112 and also the engine 114 and the shell is sealed to form the enclosure around the engine.

Accordingly, the shell provides an air-tight enclosure around the engine. Openings in the shell are provided with a gasket to seal the mounting for an accessory or the component extending externally of the shell. The shell per se is contoured to the external surface of the engine to maximize sound attenuation and to reduce the overall size of the engine and shell. By contouring the shell to that of the configuration of the engine, the size of the engine is enlarged only slightly and, accordingly, installation of the engine with the shell presents no installation problem because of the size of the shell as compared to a conventional engine. By providing high maintenance components readily accessible to the operator by extending these components externally of the shell for servicing, the shell does not inconvenience the operator in maintaining servicing of the engine. The low emission components such as the starter are mounted on the engine and extend through the shell. The shell sections can be more easily constructed to conform to the engine per se and not include the starter and other such accessories. This facilitates in the convenience of assembly of the shell on the engine. The high sound emission components are encased in the shell to reduce the overall emission of noise from the engine during operation.

The embodiments of the invention in which an exclusive property or privilege is claimed are defined as follows:

1. A sound abatement device on an internal combustion engine comprising, an internal combustion engine, a contoured integral sound attenuating shell contoured to the external surface of the engine, resilient means mounting said shell in closely spaced relation to said engine, a plurality of sections forming said shell to facilitate assembly and mounting on said engine, fastening means sealing and fastening said sections together to form said shell, means defining openings in said shell, low emission accessories mounted on said engine and extending through said openings in said shell for operating externally of said shell, high maintenance components mounted on said engine and extending through said openings in said shell for maintenance of said components and said engine from externally of said shell to thereby provide a sound abatement device on said internal combustion engine.

2. A sound abatement device on an internal combustion engine as set forth in claim 1 including engine mounting means for mounting said engine and supporting said resilient means mounting said shell.

3. A sound abatement device on an internal combustion engine as set forth in claim 1 including a bracket mounted on the engine head for supporting said resilient means.

4. A sound abatement device on an internal combustion engine as set forth in claim 1 including a bracket mounted on said engine head and a bracket mounted on said oil pan for supporting said resilient means and said shell on said engine.

5. A sound abatement device on an internal combustion engine as set forth in claim 1 including an engine mount, engine supporting means supporting said engine on said engine mount, said resilient means mounted on said engine supporting means to resiliently mount said shell relative to said engine and said engine mount.

6. A sound abatement device on an internal combustion engine as set forth in claim 1 including a ullage rod mount on said engine extending through said shell, a starter motor mounted on said mount for operation on the external side of said shell.

7. A sound abatement device on an internal combustion engine as set forth in claim 1 wherein said plurality of sections form said shell, gaskets sealing said sections to form an integral sealed shell enclosing said engine.

8. A sound abatement device on an internal combustion engine comprising, an internal combustion engine, a sound attenuating shell enclosing said engine, means defining openings in said shell, resilient means mounting said shell in closely spaced relation to said engine, a plurality of sections forming said shell to facilitate assembly and mounting on said engine, fastening means fastening and sealing said sections together to form said shell, low noise emission accessories, means mounting said accessories on said engine for extending through said openings in said shell for operation externally of said shell, high maintenance components mounted on said engine, means extending said high maintenance components through said openings in said shell for convenience in servicing of said engine, said sound absorbing shell including a plastic material loaded with metallic powder to provide a sound absorbing medium for reducing emissions from said engine through said shell.

9. A sound abatement device on an internal combustion engine as set forth in claim 8 including an engine mount, means connecting said engine mount for supporting said engine and said shell.

10. A sound abatement device on an internal combustion engine as set forth in claim 8 including means contouring said shell to the external surface of said engine.

11. A sound abatement device on an internal combustion engine as set forth in claim 8 including high maintenance components mounted on said engine extending through said shell for convenience in servicing.

12. A sound abatement device on an internal combustion engine as set forth in claim 8 including low emission accessories mounted on said engine extending through said shell for operation externally of said shell.

13. A sound abatement device on an internal combustion engine as set forth in claim 8 including an oil filter mounted on said engine extending through said shell, a ullage rod mounted on said engine for operation externally of said shell.

14. A sound abatement device on an internal combustion engine as set forth in claim 8 wherein said plurality of sections form said shell, gaskets sealing said sections to form an integral sealed shell enclosing said engine.

* * * * *